US011312527B2

(12) United States Patent
Smith et al.

(10) Patent No.: US 11,312,527 B2
(45) Date of Patent: Apr. 26, 2022

(54) SHELF-READY WRAP-AROUND SHIPPER DISPLAY SYSTEM

(71) Applicant: WestRock Shared Services, LLC, Atlanta, GA (US)

(72) Inventors: Kenneth C. Smith, Marietta, GA (US); Jeffrey H. Chapman, Villa Hills, KY (US)

(73) Assignee: WESTROCK SHARED SERVICES, LLC, Atlanta, GA (US)

( * ) Notice: Subject to any disclaimer, the term of this patent is extended or adjusted under 35 U.S.C. 154(b) by 403 days.

(21) Appl. No.: 16/478,274

(22) PCT Filed: Dec. 6, 2017

(86) PCT No.: PCT/US2017/064802
§ 371 (c)(1),
(2) Date: Jul. 16, 2019

(87) PCT Pub. No.: WO2018/106749
PCT Pub. Date: Jun. 14, 2018

(65) Prior Publication Data

US 2021/0331826 A1 Oct. 28, 2021

Related U.S. Application Data

(60) Provisional application No. 62/431,855, filed on Dec. 9, 2016.

(51) Int. Cl.
*B65D 5/32* (2006.01)
*B65D 5/54* (2006.01)

(52) U.S. Cl.
CPC ..... *B65D 5/321* (2013.01); *B65D 5/54* (2013.01)

(58) Field of Classification Search
CPC . B65D 5/32; B65D 5/321; B65D 5/54; B65D 2571/00666; B65D 71/38
(Continued)

(56) References Cited

U.S. PATENT DOCUMENTS 5,014,906 A 5/1991 Gero
5,333,779 A * 8/1994 Sykora ..... B65D 5/326 229/122.21
(Continued)

FOREIGN PATENT DOCUMENTS

DE 202010010665 U1 * 10/2010 ..... B65D 5/32
GB 2370034 A * 6/2002 ..... B65D 77/02
WO WO-2018106749 A1 * 6/2018 ..... B65D 5/725

OTHER PUBLICATIONS

International Search Report dated Feb. 6, 2018, during the prosecution of corresponding PCT Application No. PCT/US17/64802 (14 pages).

*Primary Examiner* — Peter N Helvey
*Assistant Examiner* — Phillip D Schmidt
(74) *Attorney, Agent, or Firm* — Neil G. Cohen

(57) ABSTRACT

A display system for containing and displaying product includes a tray portion and a hood portion. The tray portion includes a bottom panel, and the hood portion includes a top panel and at least one glue flap panel disposed adjacent to the top panel. The display system is convertible from a shipping configuration in which the tray and hood portions cooperate to form an enclosed carton, into a display configuration in which the hood portion is separated completely from the tray portion. The display system is configured to be transitioned from the shipping configuration to the display configuration by breaking an adhesive connection between the at least one glue flap panel and the tray portion and lifting the hood portion away from the tray portion.

11 Claims, 14 Drawing Sheets

(58) Field of Classification Search
USPC ..... 229/240, 122.21; 206/774, 736; 493/84
See application file for complete search history.

(56) References Cited

U.S. PATENT DOCUMENTS

| | | | | |
|---|---|---|---|---|
| 7,080,736 | B2 | 7/2006 | Jackson et al. | |
| 7,284,662 | B2 | 10/2007 | Debusk | |
| 7,717,324 | B2 * | 5/2010 | Keefe, Jr. ..... | B65D 5/548 229/240 |
| 8,430,297 | B2 | 4/2013 | Gatrost | |
| 9,382,041 | B2 | 7/2016 | Couture | |
| 2010/0058717 | A1 * | 3/2010 | Smith ..... | B65D 5/5445 53/461 |

* cited by examiner

SHELF-READY WRAP-AROUND SHIPPER DISPLAY SYSTEM

REFERENCE TO RELATED APPLICATIONS

This application is a National Phase application of PCT Application PCT/US17/64802, filed Dec. 6, 2017, which claims benefit of priority of U.S. Provisional Patent Application Ser. No. 62/431,855 filed on Dec. 9, 2016, both of which are hereby incorporated by reference in its entirety.

Embodiments of the present invention relate to shelf-ready wrap-around packaging systems having a shipping configuration and a display configuration.

BACKGROUND OF THE INVENTION

Retail product sales are driven by many factors. Product demand, quality, and pricing are some factors that contribute to retail product sales. Other factors may include product advertising and product location in the retail environment. Many product display devices are designed to take advantage of valuable retail space. Display devices may also be designed to utilize advertising space creatively to include product graphics, indicia, and trademarks.

Display devices and their products ideally should be easy to assemble, easy to ship, easy to set up, and require minimal time and effort from retail employees. Some retail establishments require that displays meet particular size specifications to maximize the advertising and display space for the product. Some retail establishments also require that the display be easy to identify, easy to open, easy to replenish, and easy to break down for disposal of the display. Moreover, the display ideally should be configured so that product housed in the display be readily aligned for sale, and be easy for a consumer to identify, handle, and remove from the display. In other words, many retail establishments are moving toward a display that is "shelf-ready." Many retail establishments are also moving toward displays that use less material and are therefore more environmentally friendly.

It is thus desirable to provide a display that can be produced, assembled and filled on existing equipment, is easy and inexpensive to ship, is easy to set up at the retail location, and that provides efficient delivery of product to the end-consumer.

SUMMARY OF INVENTION

According to a first aspect of the invention, there is provided a display system for containing and displaying product that includes a tray portion including a bottom panel and a hood portion including a top panel and at least one glue flap panel disposed adjacent to the top panel. The display system is convertible from a shipping configuration to a display configuration. When the display system is in the shipping configuration, the tray portion and hood portion cooperate to form an enclosed carton. When the display system is in the display configuration, the hood portion is separated completely from the tray portion. The display system is configured to be transitioned from the shipping configuration to the display configuration by breaking an adhesive connection between the at least one glue flap panel and the tray portion and lifting the hood portion away from the tray portion.

Optionally, the display system in the shipping configuration includes a second adhesive connection between a bottom front panel of the tray portion and a front panel of the hood portion. The second adhesive connection is configured so as to be broken when the hood portion is lifted away from the tray portion to transition the display system to the display configuration.

Optionally, the tray portion further includes a back panel, a bottom front panel, and first and second bottom side panels.

Optionally, the tray portion further includes first and second rear side panels, wherein the first and second rear side panels extend vertically between the bottom panel and the top panel when the display system is in the shipping configuration.

Optionally, the hood portion further includes a front panel that is disposed opposite the back panel when the display system is in the shipping configuration.

Optionally, the hood portion further includes first and second front side panels, wherein the first and second front side panels extend vertically between the bottom panel and the top panel when the display system is in the shipping configuration, wherein the first front side panel and the first rear side panel together form a first side wall of the display system in the shipping configuration, and wherein the second front side panel and the second rear side panel together form a second side wall of the display system in the shipping configuration.

Optionally, the at least one glue flap includes first and second top side glue flaps, wherein the first top side glue flap is secured to the first side wall when the display system is in the shipping configuration, wherein the second top side glue flap is secured to the second side wall when the display system is in the shipping configuration.

Optionally, the at least one glue flap includes a top rear glue flap, wherein the top rear glue flap is secured to the back panel when the display system is in the shipping configuration.

Optionally, the first and second front side panels define at least in part respective first and second notches, wherein the first and second notches are sized and configured so as to overlie the respective first and second front corner flaps when the display system is in the shipping configuration.

Optionally, the first and second notches extend partially into the front panel.

According to a second aspect of the invention, there is provided a set of blanks for forming a display system. The set of blanks include a first blank and a second blank. The first blank includes a bottom panel and is configured to form a tray portion of a set-up display system. The second blank is configured to form a hood portion of the set-up display system. The second blank includes a top panel and at least one glue flap panel hingedly connected to the top panel. The set-up display system is convertible from a shipping configuration to a display configuration. When the set-up display system is in the shipping configuration, the tray portion and hood portion cooperate to form an enclosed carton. When the set-up display system is in the display configuration, the hood portion is separated completely from the tray portion. The set-up display system is configured to be transitioned from the shipping configuration to the display configuration by breaking an adhesive connection between the at least one glue flap panel and the tray portion and lifting the hood portion away from the tray portion.

Optionally the set-up display system in the shipping configuration includes a second adhesive connection between a bottom front panel of the tray portion and a front panel of the hood portion. The second adhesive connection is configured so as to be broken when the hood portion is lifted away from the tray portion to transition the set-up display system to the display configuration.

Optionally, the first blank further includes a back panel, a bottom front panel, and first and second bottom side panels.

Optionally, the first blank further includes first and second rear side panels, wherein the first and second rear side panels are configured to extend vertically between the bottom panel and the top panel when the set-up display system is in the shipping configuration.

Optionally, the second blank further includes a front panel that is disposed opposite the back panel when the set-up display system is in the shipping configuration.

Optionally, the second blank further includes first and second front side panels, wherein the first and second front side panels extend vertically between the bottom panel and the top panel when the set-up display system is in the shipping configuration, wherein the first front side panel and the first rear side panel together form a first side wall of the display system in the shipping configuration, and wherein the second front side panel and the second rear side panel together form a second side wall of the set-up display system in the shipping configuration.

Optionally, the at least one glue flap includes first and second top side glue flaps, wherein the first top side glue flap is secured to the first side wall when the set-up display system is in the shipping configuration, wherein the second top side glue flap is secured to the second side wall when the set-up display system is in the shipping configuration.

Optionally, the at least one glue flap includes a top rear glue flap, wherein the top rear glue flap is secured to the back panel when the set-up display system is in the shipping configuration.

Optionally, the first and second front side panels define at least in part respective first and second notches, wherein the first and second notches are sized and configured so as to overlie the respective first and second front corner flaps when the set-up display system is in the shipping configuration.

Optionally, the first and second notches extend partially into the front panel.

According to a third aspect of the invention, a composite blank is provided. The composite blank is formed by joining a bottom front panel of the tray blank to a lowermost portion of a front panel of the hood blank.

Within the scope of this application it is envisaged that the various aspects, embodiments, examples, features and alternatives set out in the preceding paragraphs, in the claims and in the following description and drawings may be taken independently or in any combination thereof. For example, features described in connection with one embodiment are applicable to all embodiments unless there is incompatibility of features.

DETAILED DESCRIPTION OF EXEMPLARY EMBODIMENTS

Detailed description of specific embodiments of blanks and a shipper display system are disclosed herein. It will be understood that the disclosed embodiments are merely examples of the way in which certain aspects of the invention can be implemented, and do not represent an exhaustive list of all the ways the invention may be embodied. As used herein, the word "exemplary" is used expansively to refer to embodiments that serve as illustrations, specimens, models, or patterns. Indeed, it will be understood that the shipper display systems, tray and hood portions, and blanks described herein may be embodied in various and alternative forms. The Figures are not necessarily to scale and some features may be exaggerated or minimized to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 3:
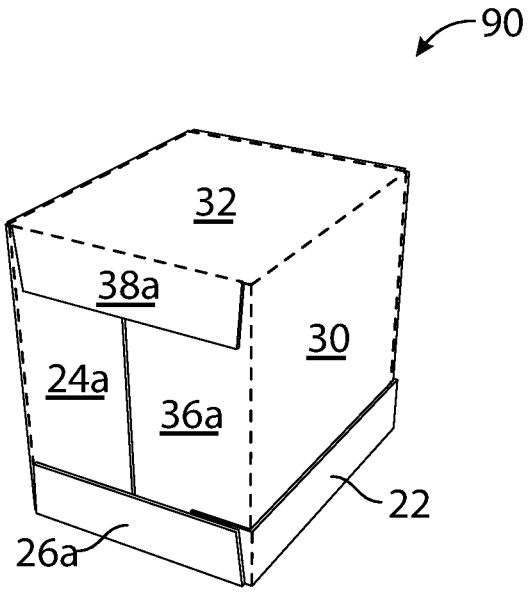
FIG. 3 is a perspective view of the shipper display system formed from the blanks of FIG. 1 and FIG. 2, shown in the shipping configuration.
Figure 12:
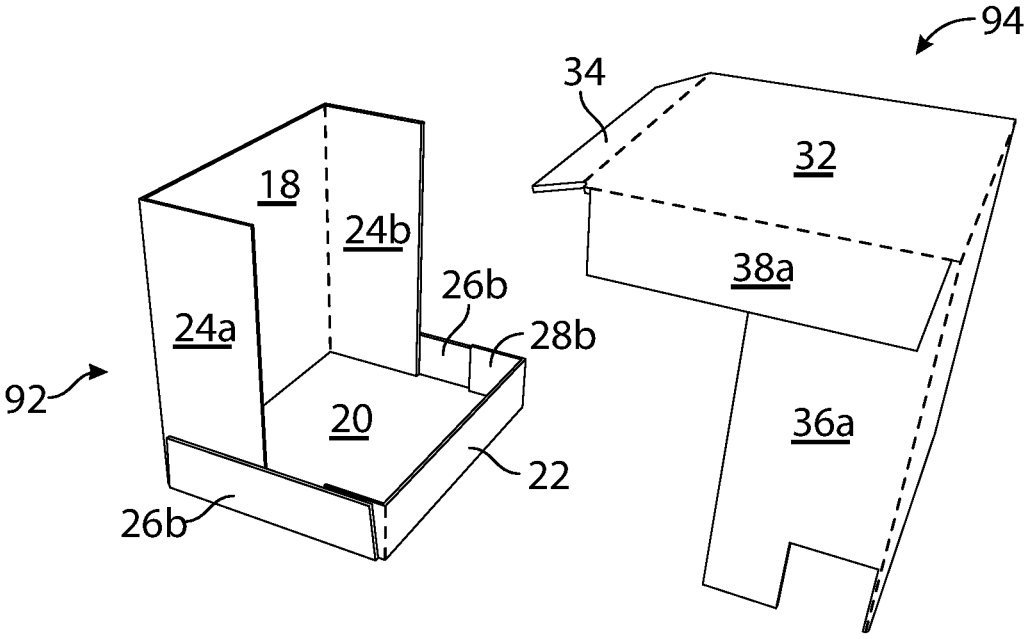
FIG. 12 is a perspective view of the shipper display system of FIG. 3, shown in the display configuration in which the hood portion has been completely removed from the tray portion.

A shipper display system 90 is disclosed that includes a tray portion 92 as well as a removable hood portion 94. The tray portion 92 and hood portion 94 are configured so that they may be separated from one another when the system 90 is converted from its shipper configuration (shown in FIG. 3), into a display configuration (shown in FIGS. 12 and 13). The shipper display 90 in its display configuration may form a fully- or substantially-enclosed six-sided carton as shown in FIG. 3. The tray portion 92 and hood portion 94 are generally complementary in shape and configured to fit together as shown to form the enclosed carton with a relatively minimal amount of overlap.

Figure 1:
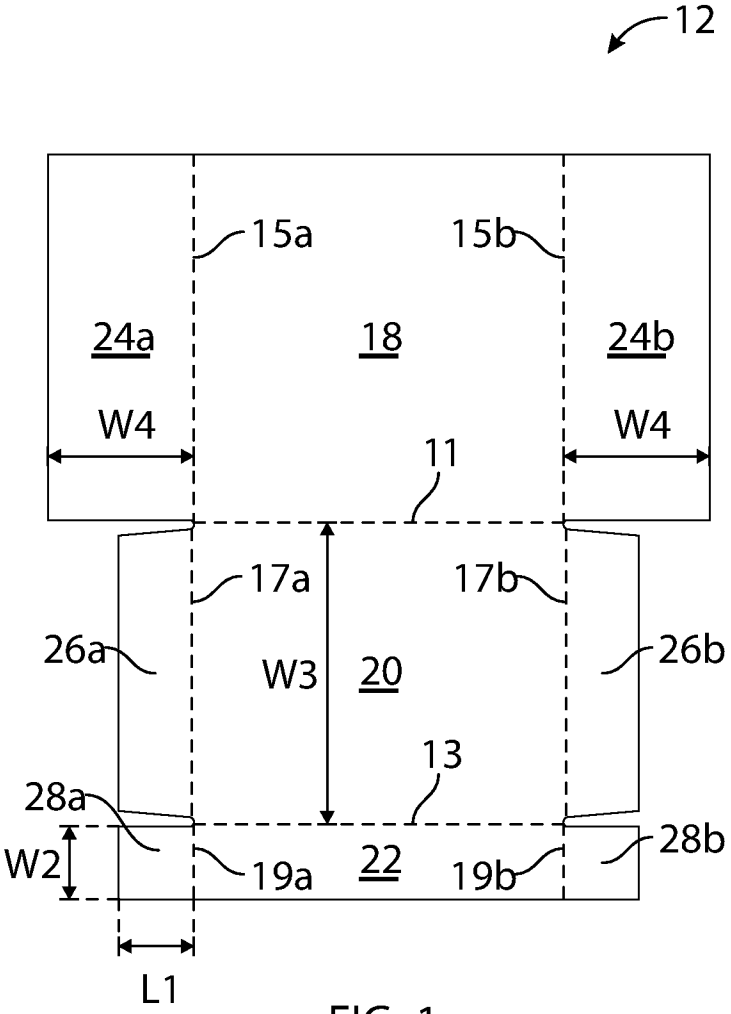
FIG. 1 is a top plan view of a blank used to form a tray portion of a shipper display system according to one embodiment of the invention.

Referring to FIG. 1, there is shown a tray blank 12 for forming the tray portion 92 (see FIG. 13) of the shipper display system 90. Tray blank 12 includes a plurality of panels. A back panel 18 is hinged to a bottom panel 20 by a transverse fold line 11. The bottom panel 20 is hinged to a bottom front panel 22 by a transverse fold line 13. First and second rear side panels 24*a*, 24*b* are hingedly connected at opposite first and second sides of back panel 18 via respective longitudinal fold lines 15*a*, 15*b*. First and second bottom side panels 26*a*, 26*b* are hingedly connected at opposite first and second sides of bottom panel 20 via respective longitudinal fold lines 17*a*, 17*b*. First and second front corner flaps 28*a*, 28*b* are hingedly connected at opposite first and second sides of bottom front panel 22 via respective longitudinal fold lines 19*a*, 19*b*. As shown in the illustrated embodiment, fold lines 15*a*, 17*a*, 19*a* (and fold lines 15*b*, 17*b*, 19*b*) may be substantially or completely aligned with one another so as to comprise a single fold line. Back panel 18 has a width W3 (as measured between fold line 11 and fold line 13). First and second rear side panels 24*a*, 24*b* each have a width W4 (as measured between respective fold lines 15*a*, 15*b* and a free edge of respective first and second rear side panels 24*a*, 24*b*). First and second front corner flaps 28*a*, 28*b* each have a width W2 and a length L1.

Figure 2:
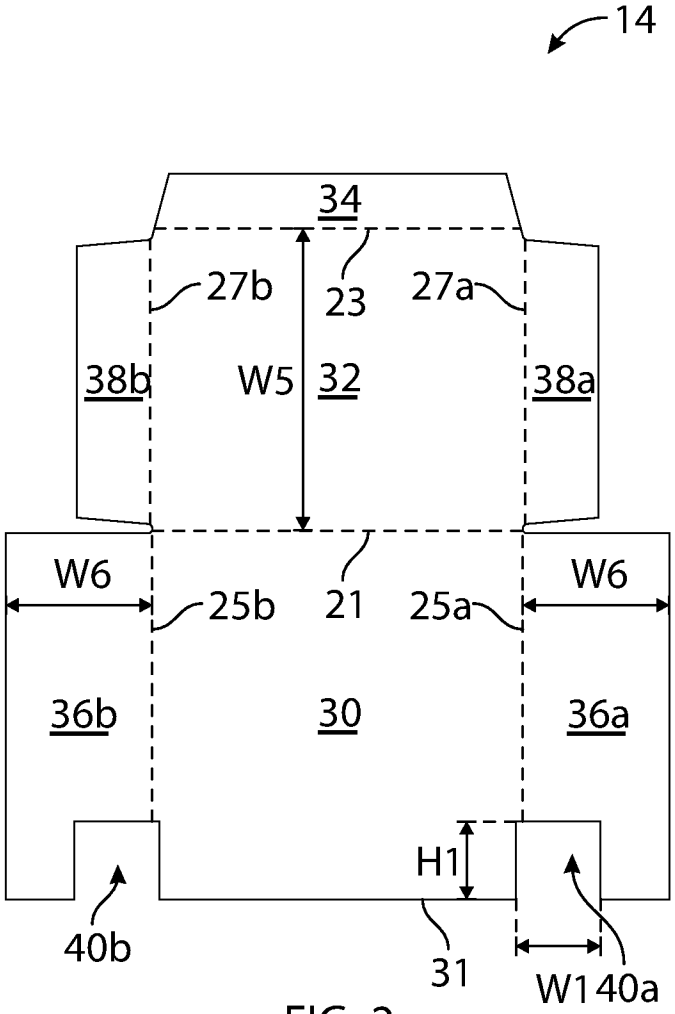
FIG. 2 is a top plan view of a blank used to form a hood portion of a shipper display system according to one embodiment of the invention.

Referring to FIG. 2, there is shown a hood blank 14 for forming hood portion 94 of shipper display system 90. Hood blank 14 includes a plurality of panels. A front panel 30 is hinged to a top panel 32 by a transverse fold line 21. The top panel 32 is hinged to a top rear glue flap 34 by a transverse fold line 23. First and second front side panels 36*a* and 36*b* are hingedly connected at opposite first and second sides of front panel 30 via respective longitudinal fold lines 25*a*, 25*b*. First and second top side glue flaps 38*a*, 38*b* are hingedly connected at opposite first and second sides of top panel 32 via respective longitudinal fold lines 27*a*, 27*b*. As shown in the illustrated embodiment, fold lines 25*a*, 27*a* (and fold lines 25*b*, 25*b*) may be substantially or completely aligned with one another so as to comprise a single fold line. Top panel 32 has a width W5 (as measured between fold line 21 and fold line 23) that is preferably equal or substantially equal to the width W3 of bottom panel 20. First and second front side panels 36*a*, 36*b* each have a width W6 (as measured between respective fold lines 25*a*, 25*b* and a free edge of respective first and second front side panels 36*a*, 36*b*). Width W6 is preferably equal or substantially equal to width W4 of first and second rear side panels 24*a*, 24*b*. Width W6 and width W4 are preferably equal or substantially equal to about one-half the widths W3, W5 of bottom panel 20 and top panel 32.

Hood blank 14 includes first and second notches 40*a*, 40*b* that are struck primarily from a bottom edge of respective first and second front side panels 36*a*, 36*b*. As shown in the illustrated embodiment, first and second notches 40*a*, 40*b* also extend slightly into front panel 30. In a preferred embodiment, first and second notches 40*a*, 40*b* extend into front panel 30 a distance equal to about the thickness of blank 12 and/or blank 14. Notches 40*a*, 40*b* have a width W1 that is preferably equal to about or slightly larger than the length L1 of first and second front corner flaps 28*a*, 28*b*, and a height H1 that is preferably equal to about or slightly larger than the width W2 of first and second front corner flaps 28*a*, 28*b*. Notches 40*a*, 40*b* are configured to overlie respective first and second front corner flaps 28*a*, 28*b* when the shipper display 90 is in its shipping configuration, thereby preventing the formation of a three-ply thickness section of the shipper display 90 where the first and second front corner flaps 28*a*, 28*b* overlie the respective first and second bottom side panels 26*a*, 26*b*.

Blanks 12 and 14 are formed from a sheet of suitable substrate. It is to be understood that, as used herein, the term "suitable substrate" includes all manner of foldable sheet material such as paperboard, corrugated board, cardboard, plastic, combinations thereof, and the like.

Turning to the construction of the shipper display system 90 as illustrated in FIG. 3, it is envisaged that shipper display system 90 can be formed using standard wrap-around case packing equipment. The forming process is not limited to that described below and may be altered according to particular manufacturing requirements.

Figure 4:
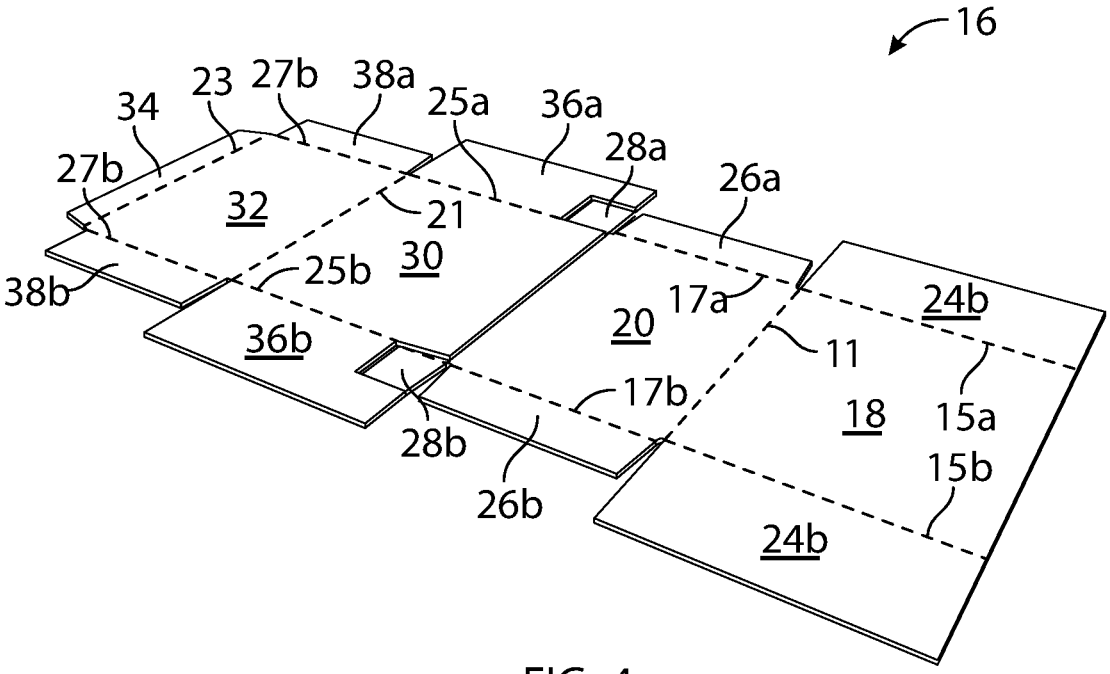
FIGS. 4-10 are various perspective views showing the construction of the shipper display system of FIG. 3 from the blanks of FIGS. 1 and 2.

Tray blank 12 and hood blank 14 are positioned with their interior surface facing up and aligned in the partially-overlapping configuration shown in FIG. 4. More specifically, front panel 30 of hood blank 14 is positioned such that its lowermost portion overlies bottom front panel 22 of tray blank 12. Bottom free edge 31 of front panel 30 is generally aligned with and overlaps fold line 13 of tray blank 14. Notches 40*a*, 40*b* are positioned so as to overlie respective first and second front corner flaps 28*a*, 28*b*. Hot-melt adhesive or other appropriate adhesive can be used to secure an exterior surface of the lowermost portion of front panel 30 to an interior surface of bottom front panel 22, thereby joining tray blank 12 and hood blank 14 together to form composite blank 16. Preferably, tray blank 12 and hood blank 14 can be joined together in the described configuration by two-piece joiner equipment or a Bobst poly joiner.

Figure 5:
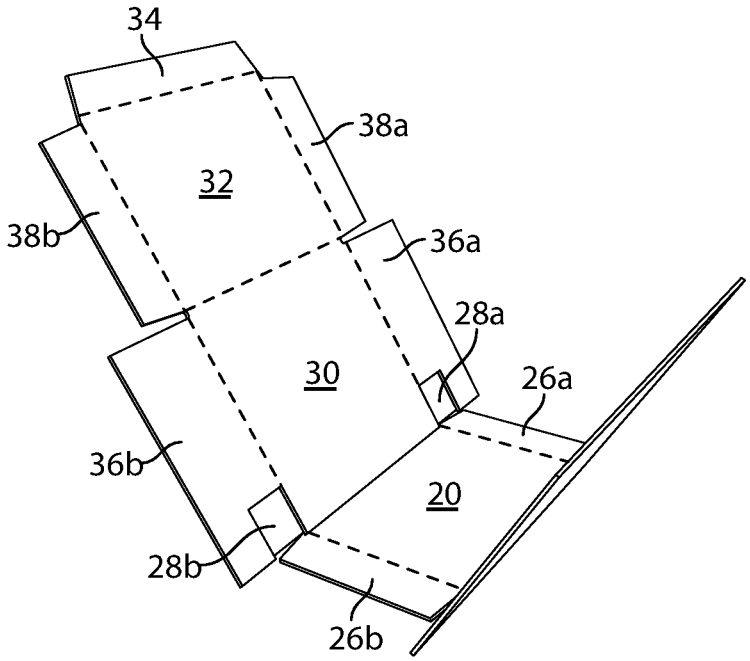
Figure 6:
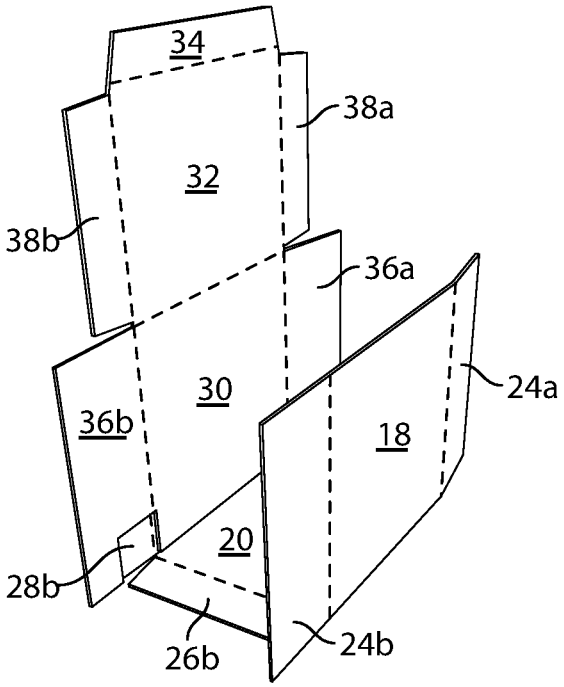

Referring to FIGS. 5 and 6, composite blank 16 (comprising tray blank 12 and hood blank 14) is folded inwardly about fold line 11 until back panel 18 and first and second rear side panels 24*a*, 24*b* are oriented in a substantially vertical orientation (as shown in FIG. 6). Composite blank 16 is also folded inwardly about fold line 13 until the panels making up hood blank 14 (including, e.g., front panel 30) are oriented in a substantially vertical orientation (as shown in FIG. 6).

Figure 7:
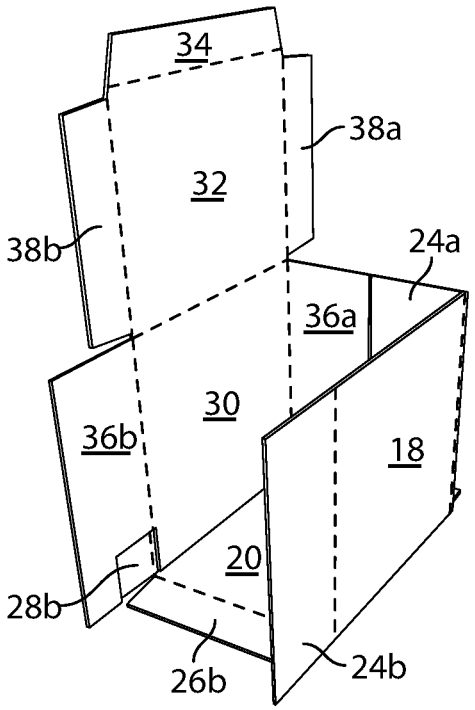
Figure 8:
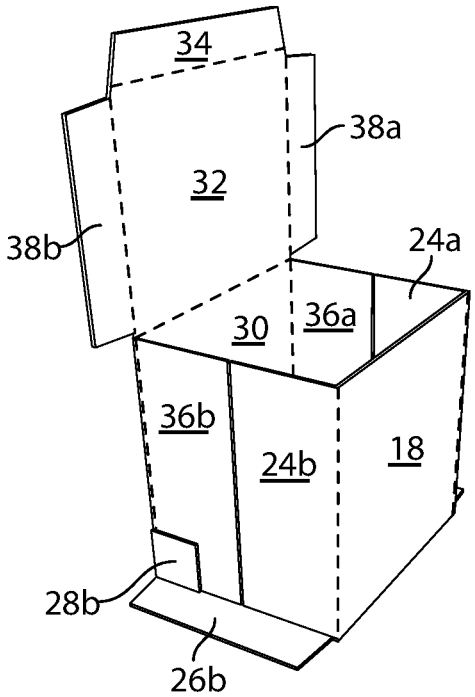

Referring to FIG. 7, first front side panel 36*a* and first front corner flap 28*a* are folded inwardly about respective fold lines 25*a* and 19*a* until they are substantially perpendicular to front panel 30. First rear side panel 24*a* is folded inwardly about fold line 15*a* until it is substantially perpendicular to back panel 18. First front side panel 36*a*, first rear side panel 24*a*, and first front corner flap 28*a* together define a first side wall of the shipper display system 90. Referring to FIG. 8, second front side panel 36*b* and second front corner flap 28*b* are folded inwardly about respective fold lines 25*b* and 19*b* until they are substantially perpendicular to front panel 30. Second rear side panel 24*b* is folded inwardly about fold line 15*b* until it is substantially perpendicular to back panel 18. Second front side panel 36*b*, second rear side panel 24*b*, and second front corner flap 28*b* together define a second side wall of the shipper display system 90.

Figure 9:
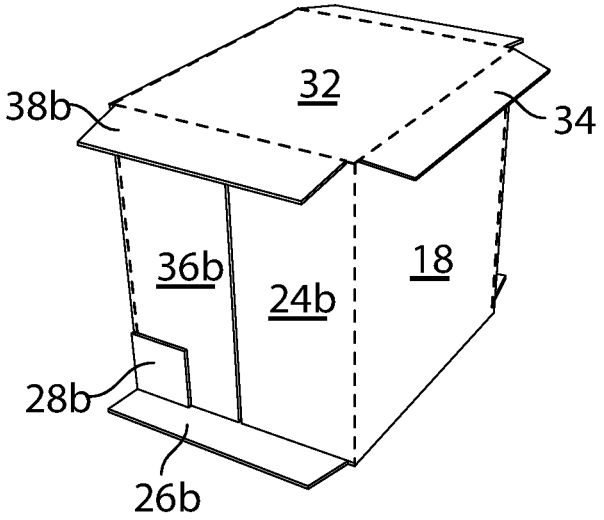
Figure 10:
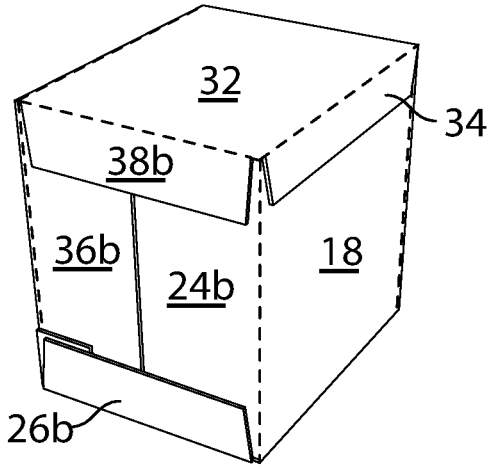

Referring to FIG. 9, top panel 32 is folded inwardly about fold line 21 until it is an orientation substantially perpendicular to front panel 30 and parallel to bottom panel 20. Referring to FIG. 10, glue or other adhesive treatment is applied to the interior surfaces of first and second bottom side panels 26*a*, 26*b* or, alternatively, to corresponding portions of the exterior surfaces of first and second front corner flaps 28*a*, 28*b* and first and second rear side panels 24*a*, 24*b*. Preferably, glue or adhesive treatment is not applied to the portions of first and second bottom side panels 26*a*, 26*b* that overlie first and second front side panels 36*a*, 36*b* so as to facilitate the removal of the hood portion 94 during the transition of the shipper display system 90 to its display configuration. First and second bottom side panels 26*a* and 26*b* are then folded inwardly about respective fold lines 17*a*, 17*b*, bringing their interior surfaces into contact with the exterior surfaces of 28*a* and first rear side panel 24*a* (and 28*b* and second rear side panel 24*b*) and securing them thereto. Glue or other adhesive treatment is applied to the interior surfaces of first and second top side glue flaps 38*a*, 38*b* and top rear glue flap 34 or, alternatively, to corresponding portions of the exterior surfaces of first front side panel 36*a*, first rear side panel 24*a*, second front side panel 36*b*, second rear side panel 24*b*, and back panel 18. First and second top side glue flaps 38*a*, 38*b* are then folded inwardly about respective fold lines 27*a*, 27*b*, bringing their interior surfaces into contact with the exterior surfaces of first front side panel 36*a* and first rear side panel 24*a* (and second front side panel 36*b* and second rear side panel 24*b*) and securing them thereto. Top rear glue flap 34 is folded inwardly about fold line 23, bringing its interior surface into contact with the exterior surface of back panel 18 and securing it thereto. This completes the construction of the shipper display system 90 into its shipping configuration as shown in FIG. 3.

Figure 11:
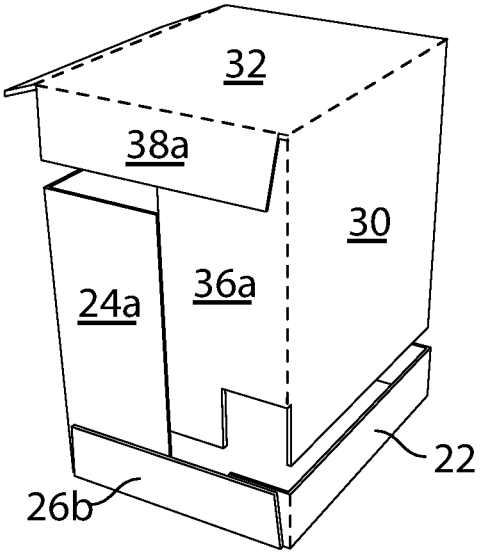
FIG. 11 is a perspective view of the shipper display system of FIG. 3 as it is being converted from the shipping configuration to the display configuration by removing the hood portion from the tray portion.

Referring to FIG. 11, the shipper display 90 can be converted from its shipping configuration to its display configuration by separating the hood portion 94 from the tray portion 92. This can be achieved by pulling the glue flaps 38*a*, 38*b*, and 34 away from the shipper display 90 so as to break the adhesive seal between these flaps and first and second rear side panels 24*a*, 24*b* and back panel 18 of tray portion 92. The hood portion 94 can then be lifted up and away from the tray portion 92 by breaking the adhesive connection between the lowermost portion of front panel 30 and bottom front panel 22 that was used to join the two blanks. Preferably the adhesive connection between front panel 30 and bottom front panel 22 is configured such that it can be broken relatively easily, e.g., by simply pulling the hood portion 94 and tray portion 92 firmly apart. Advantageously, in the preferred embodiment there are no other adhesive connections between the tray portion 92 and the lower section of the hood portion 94, thereby facilitating a quick and clean separation of the hood portion 94 from the tray portion 92.

Figure 13:
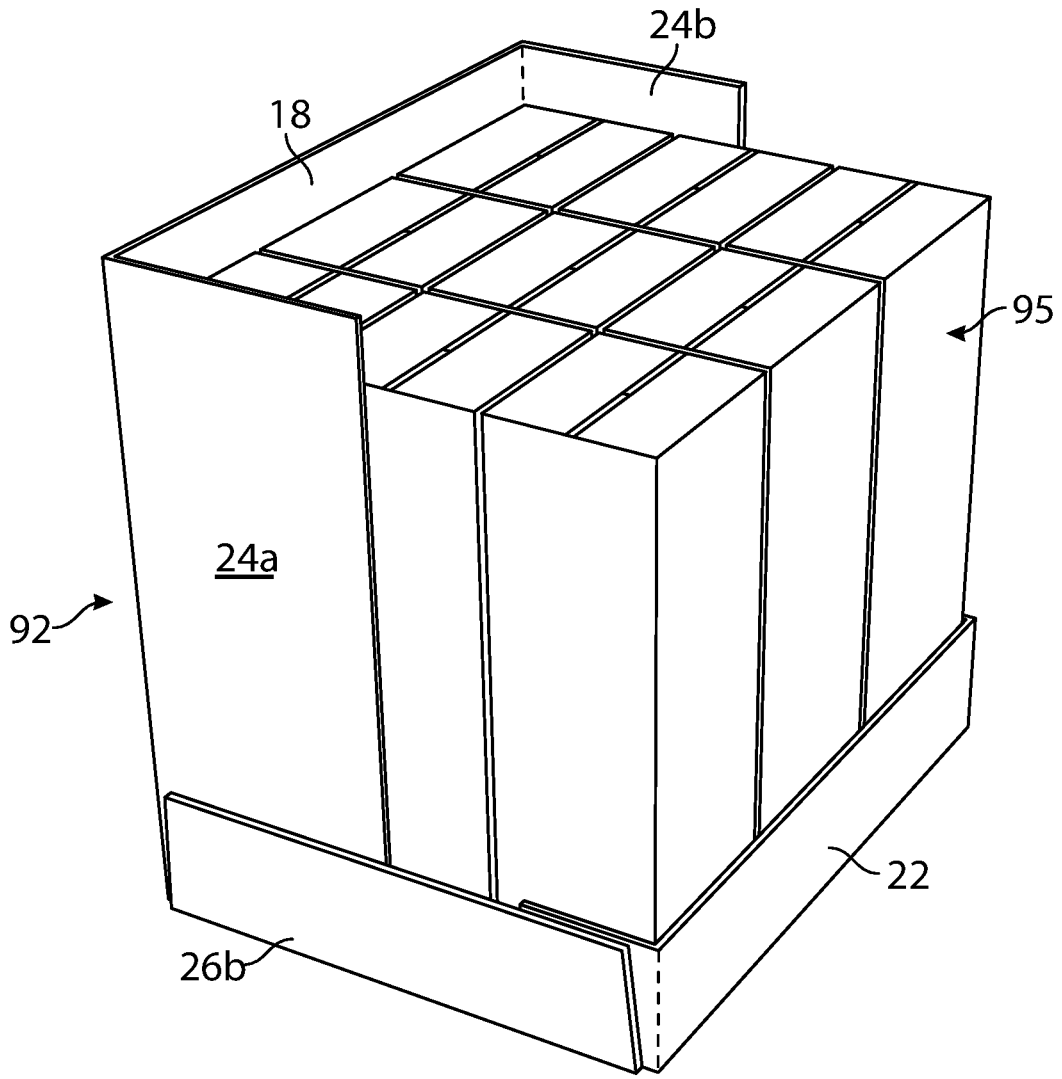
FIG. 13 is a perspective view of the shipper display system of FIG. 3, showing the tray portion in the display configuration and containing a plurality of articles.

Once the hood portion 94 is removed, product housed within the tray portion 92, such as articles 95 in the illustrated embodiment, is exposed and ready for merchandising by a consumer, as shown in FIG. 13. Thus, the shipper display 90 in its display configuration is "shelf ready" or "retail ready."

As will be apparent to one of ordinary skill in the art, there are various modifications that may be made to blank 12 and/or blank 14 without departing from the spirit of the invention. The following is a non-exhaustive list of the types of modifications that are considered to be within the scope of the invention: the dimensions of the overall blanks (and thus the overall dimensions of the shipper display) may be modified based on customer preferences; the placement of certain flaps and/or panels relative to other flaps and/or panels may be moved to accommodate different types of equipment for forming the blanks and/or packing the shipper display; the placement of the glue areas may be altered (for example, more glue areas or larger glue areas may be required as the dimensions of the shipper display increase); the shape and/or configuration of various panels may be modified as desired; various fold lines may be modified or added as appropriate; and/or the shipper display may optionally include a variety of cutouts, apertures, or tabs to assist with the conversion of the shipper display.

Figure 14:
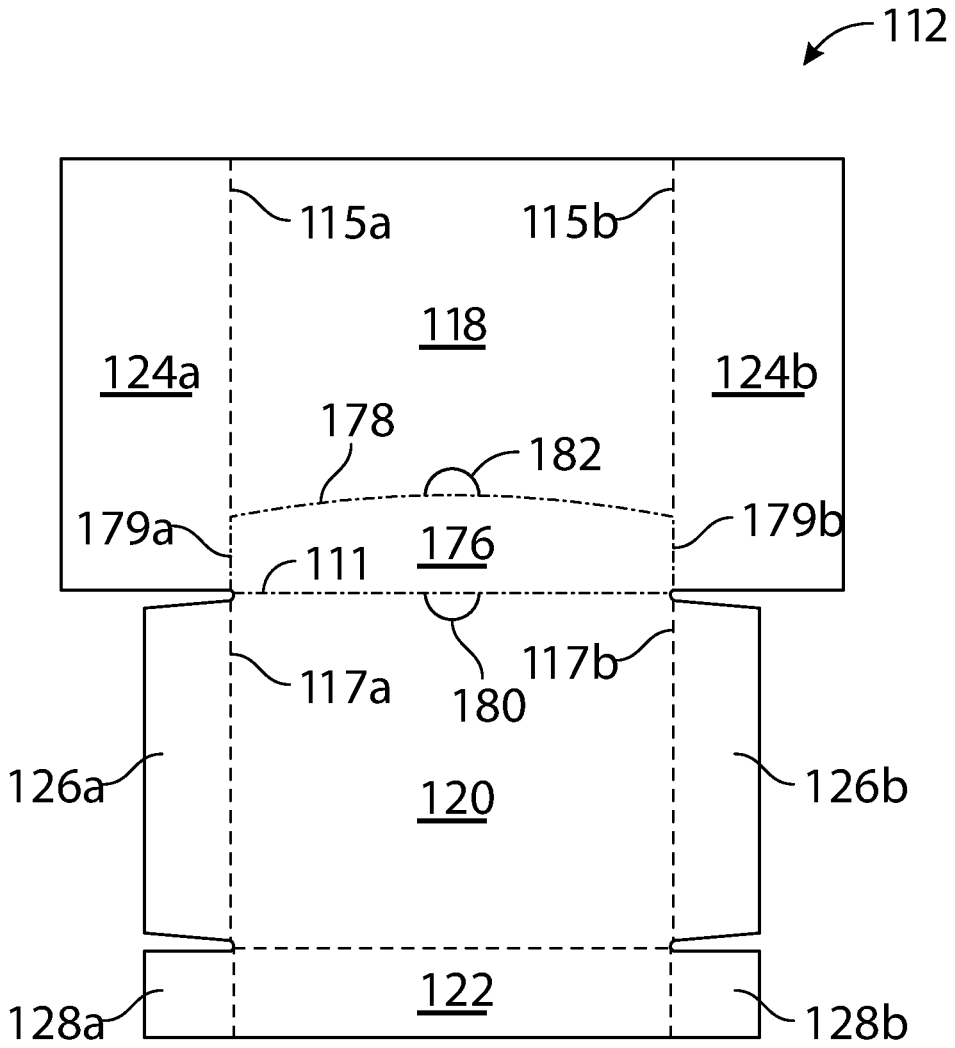
FIG. 14 is a top plan view of a blank used to form a tray portion of a shipper display system according to a second embodiment of the invention, in which the tray portion includes a removable dispensing panel.
Figure 15:
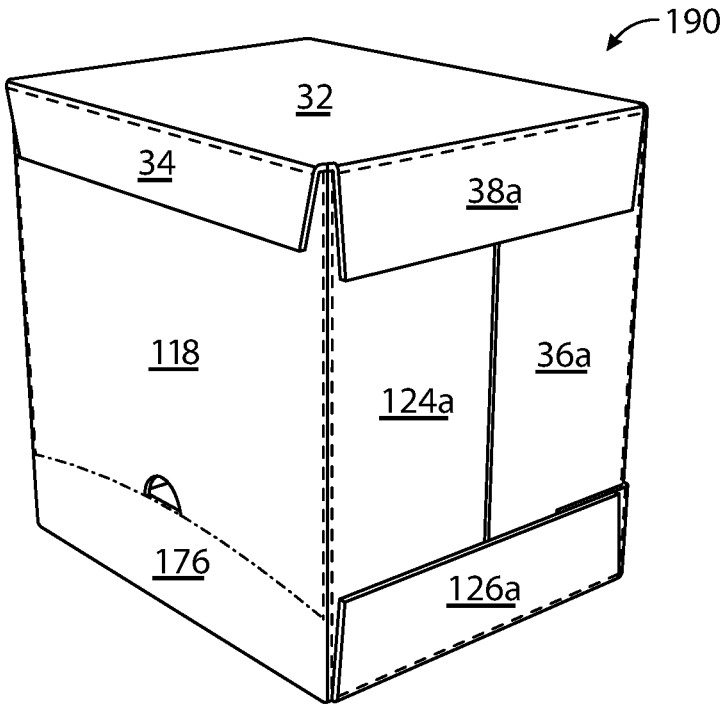
FIG. 15 is a perspective view of the shipper display system formed from the blanks of FIGS. 14 and 2, shown in the shipping configuration with the dispensing panel intact.
Figure 16:
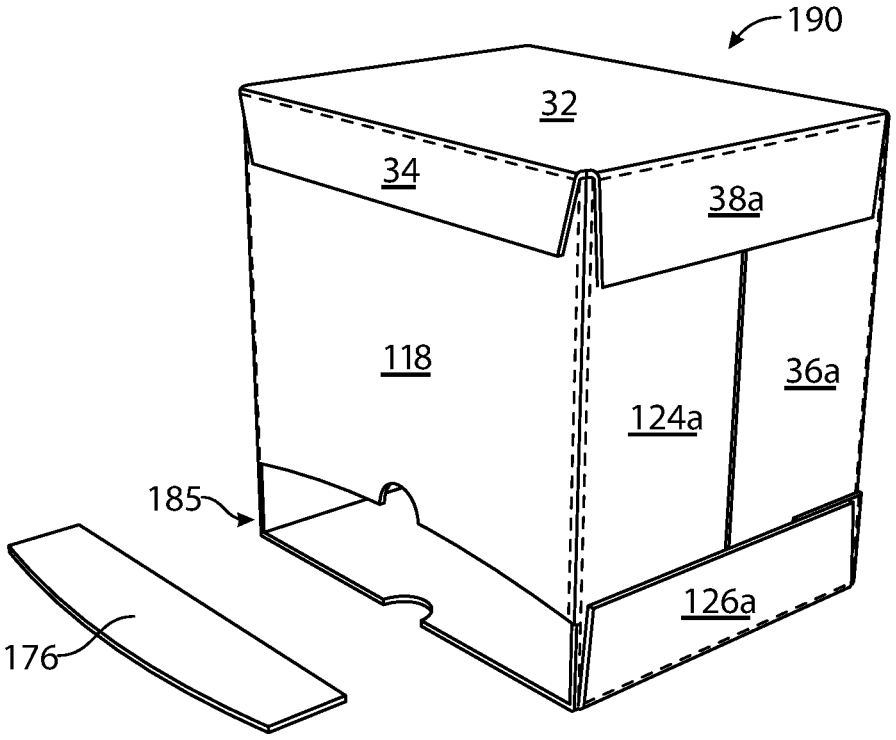
FIG. 16 is a perspective view of the shipper display system of FIG. 15 with the dispensing panel removed.

Referring to FIG. 14 there is shown a second embodiment of a tray blank 112 that, together with hood blank 14, forms a second embodiment of a shipper display 190 (shown in FIGS. 15 and 16). Blank 112 and the corresponding shipper display 190 can be generally similar to the blank 12 and shipper display 90 discussed above, and like or similar reference numbers in the figures indicate like or similar elements. Blank 112 includes a back panel 118 that can be generally similar to back panel 18 of blank 12. A primary difference between back panel 18 and back panel 118 is that back panel 118 includes a removable dispenser panel 176 defined by tear lines 179*a*, 179*b*, 111, and 178. In the illustrated embodiment, dispenser panel 176 is generally rectangular in shape and is disposed along a lowermost portion of back panel 118. In other embodiments, however, a dispenser panel may form a different shape and/or be situated in a different location. Top tear line 178 extends across back panel 118 between fold lines 115*a* and 115*b*. Bottom tear line 111 is disposed along a lowermost edge of back panel 118 that separates back panel 118 from bottom panel 120. First and second side tear lines 179*a*, 179*b* are aligned with respective fold lines 115*a*, 115*b* and connect outermost portions of top and bottom tear lines 178, 111. In the constructed display 190, dispenser panel 176 is configured to be removable by a user to form a dispenser opening 185 (as shown in FIG. 16) from which articles can be removed from the shipper display 190. A first semi-circular access cutout 182 is formed in back panel 118 and disposed adjacent to and above a central portion of top tear line 182. A second semi-circular access cutout 180 is formed in bottom panel 120 and disposed adjacent to and below a central portion of bottom tear line 111. Removal of the dispenser panel 176 may be initiated by inserting a finger or tool into the shipper display 190 through first and/or second access cutouts 182, 180 and pulling the dispenser panel 176 away from the shipper display 190, causing dispenser panel 176 to tear free from shipper display 190 along tear lines 178, 111, 179*a*, 179*b*. In certain applications, articles may be dispensed from the shipper display 190 without ever separating the hood portion from the tray portion. Instead, dispenser opening 185 will provide the sole access to the display's contents. Alternatively, dispenser panel 176 may not be removed for certain applications and the display's contents can instead be accessed by separating the hood portion from the tray portion. In still other applications, both means of access may be employed simultaneously.

Figure 17:
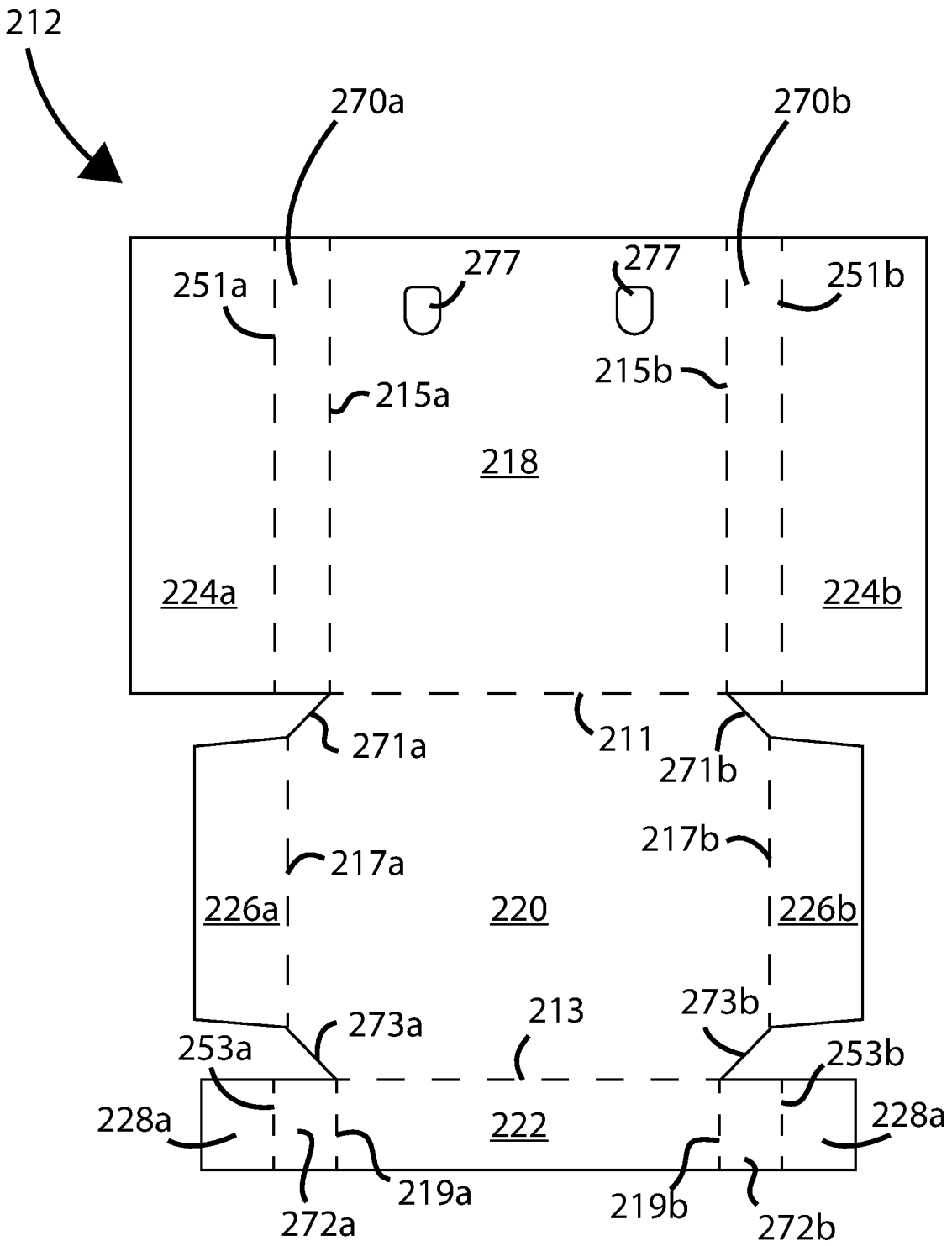
FIG. 17 is a top plan view of a blank used to form a tray portion of a shipper display system according to a third embodiment of the invention.
Figure 18:
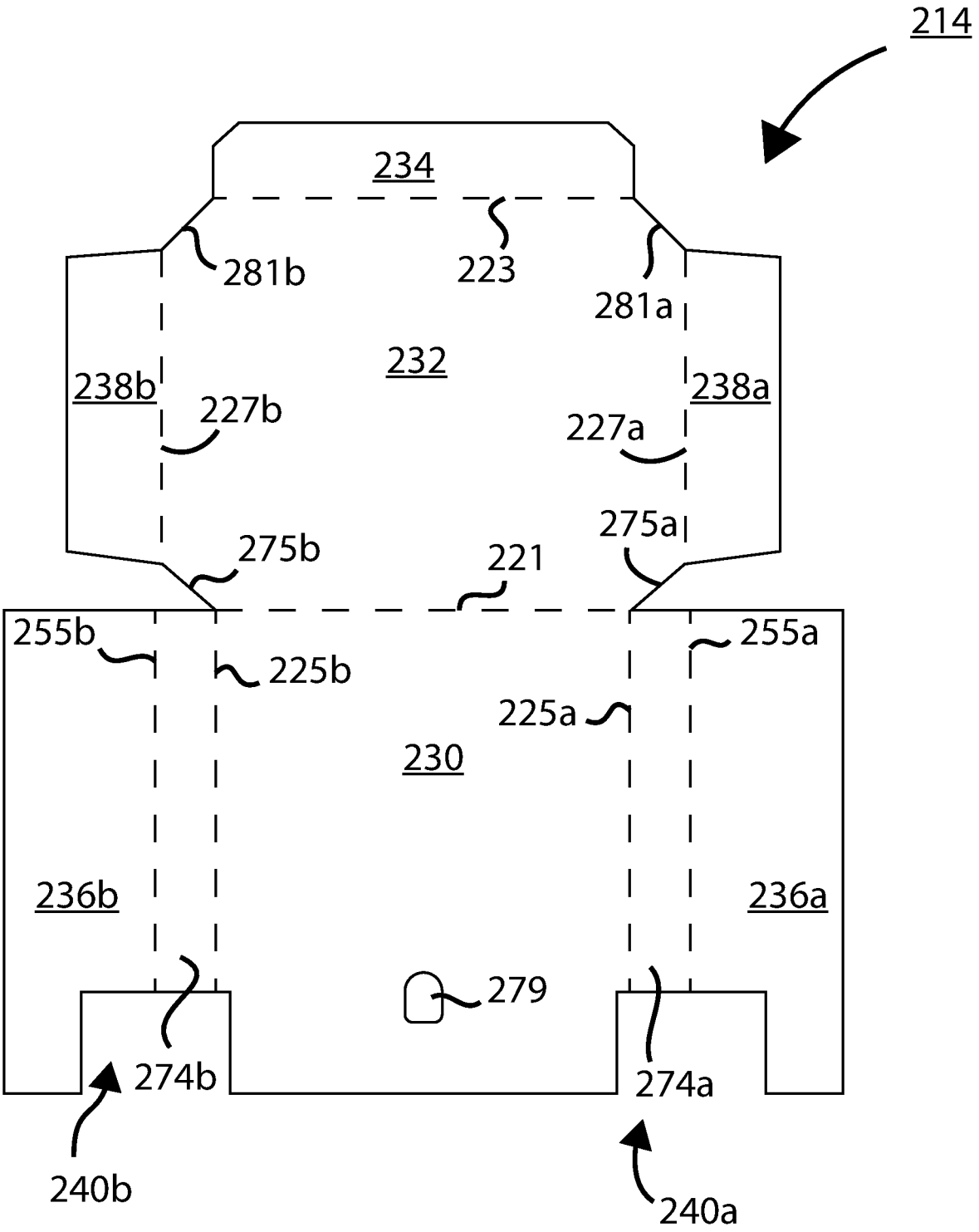
FIG. 18 is a top plan view of a blank used to form a hood portion of a shipper display system according to a third embodiment of the invention.
Figure 19:
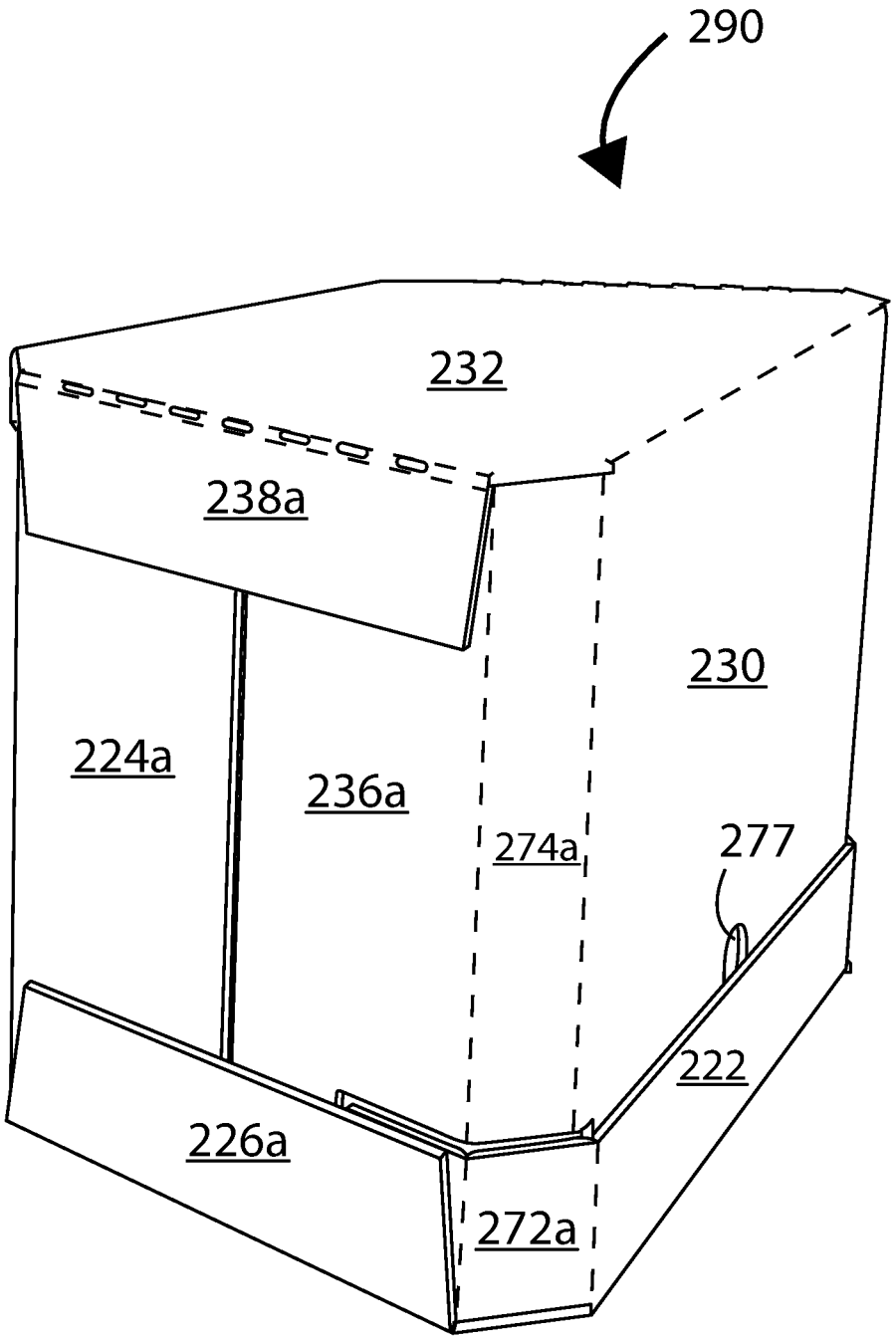
FIG. 19 is a first perspective view of the shipper display system formed from the blanks of FIGS. 17 and 18, shown in the shipping configuration.
Figure 20:
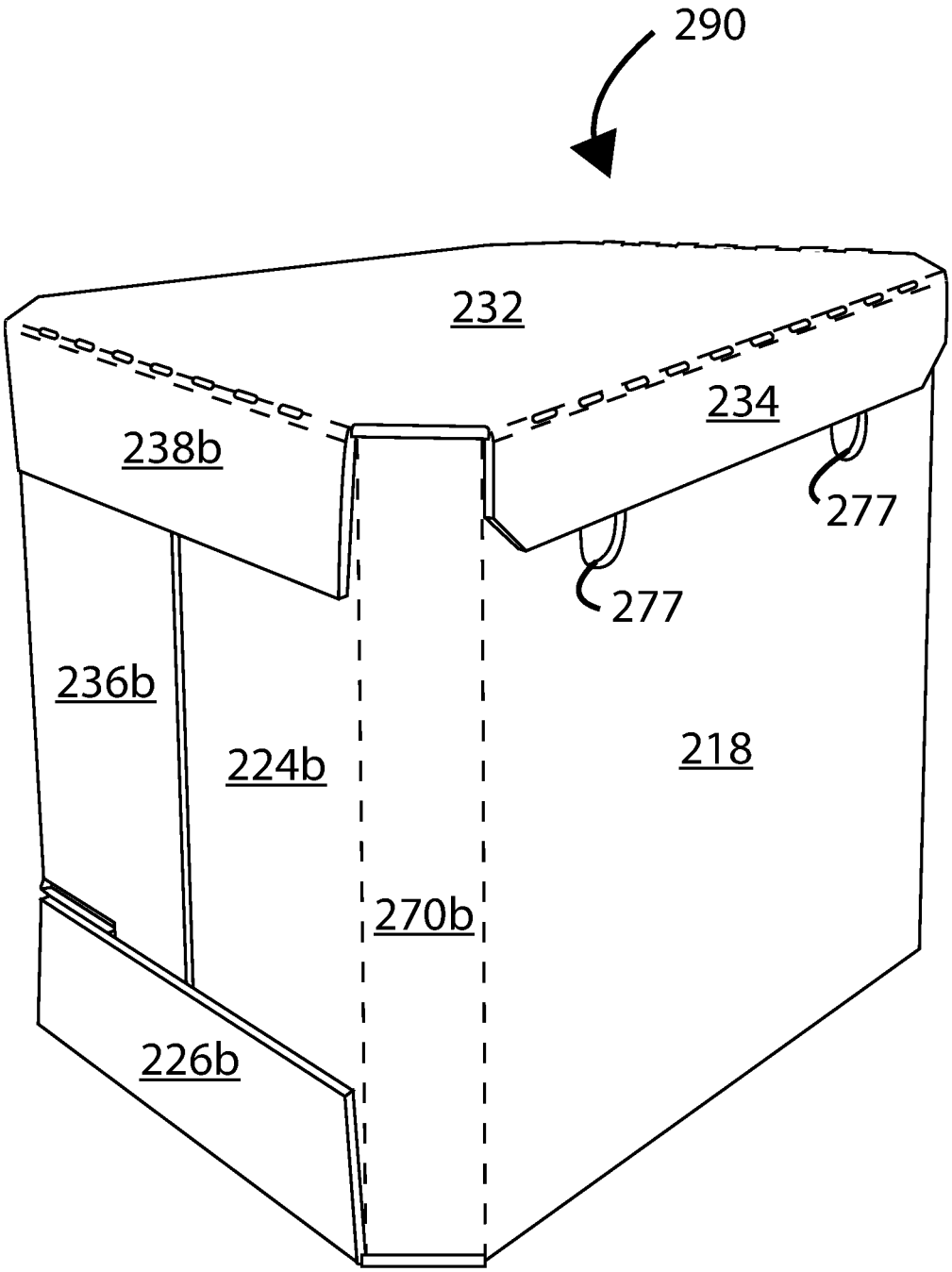
FIG. 20 is a second perspective view of the shipper display system of FIG. 19, shown in the shipping configuration.
Figure 21:
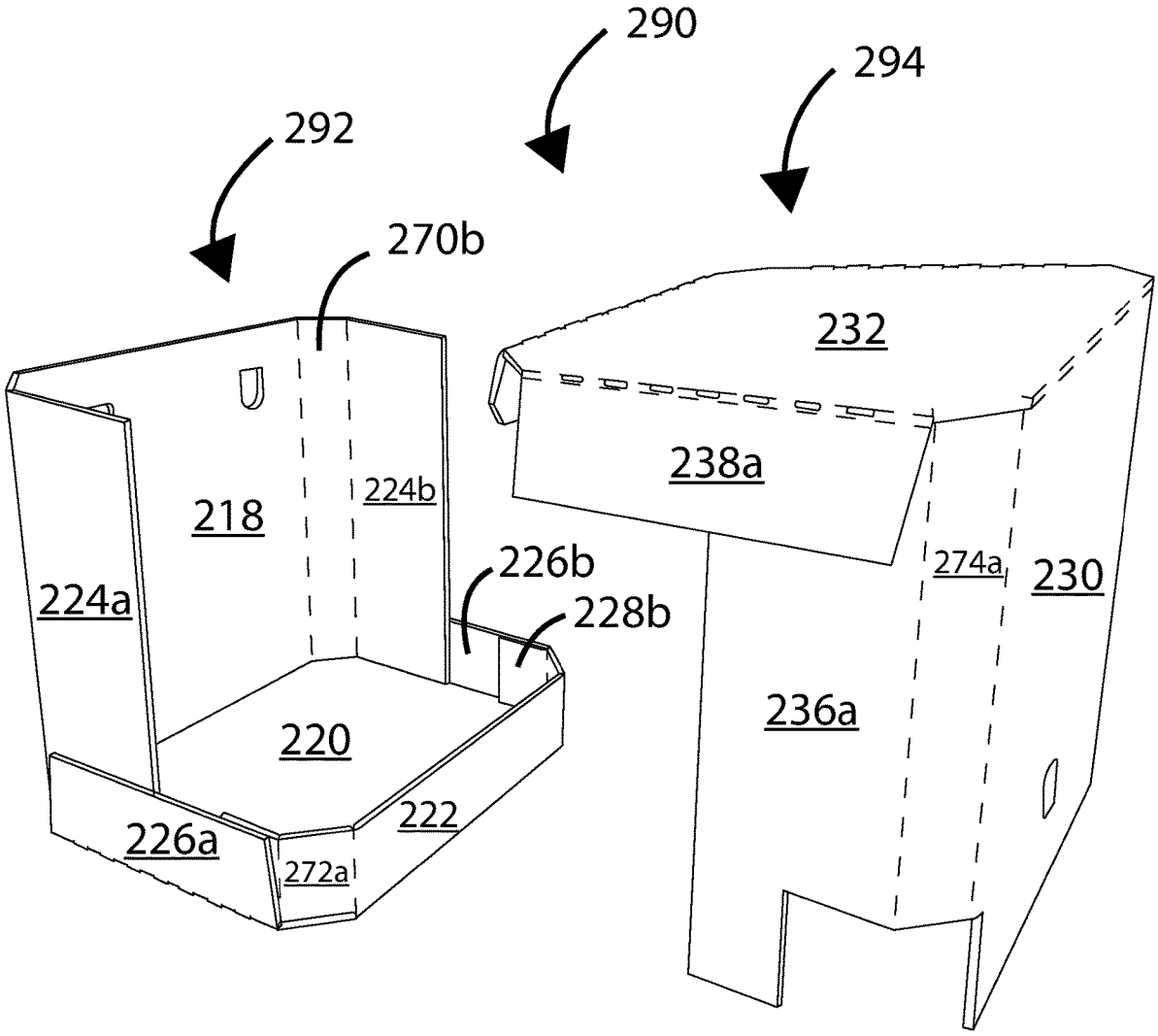
FIG. 21 is a perspective view of the shipper display system of FIG. 19, shown in the display configuration in which the hood portion has been completely removed from the tray portion.

Referring to FIG. 17 there is shown a tray blank 212 that, together with hood blank 214 (shown in FIG. 18), forms a third embodiment of a shipper display 290 (shown in FIGS. 19-21). Blanks 212, 214 and the corresponding shipper display 290 can be generally similar to the blanks 12, 14 and shipper display 90 discussed above, and like or similar reference numbers in the figures indicate like or similar elements.

The primary difference between shipper display 290 and shipper display 90 is that shipper display 290 includes mitered corner walls as shown. The mitered corner walls are provided by a plurality of corner panels. Tray blank 212 includes a first rear corner panel 270*a* disposed between first rear side panel 224*a* and back panel 18 and hingedly connected thereto along respective longitudinal fold lines 251*a*, 215*a*. Tray blank 212 also includes a second rear corner panel 270*b* disposed between second rear side panel

224*b* and back panel 18 and hingedly connected thereto along respective longitudinal fold lines 251*a*, 215*b*. A first bottom front corner panel 272*a* is disposed between first front corner flap 228*a* and bottom front panel 222 and hingedly connected thereto along respective longitudinal fold lines 253*a*, 219*a*. A second bottom front corner panel 272*b* is disposed between second front corner flap 228*b* and bottom front panel 222 and hingedly connected thereto along respective longitudinal fold lines 253*b*, 219*b*. Bottom panel 220 includes angled corner edges 271*a*, 271*b*, 273*a*, 273*b* that are sized and disposed so as to abut the adjacent edge of respective corner panels 270*a*, 270*b*, 272*a*, 272*b* when the shipper display 290 is constructed.

Hood blank 214 includes a first front corner panel 274*a* disposed between first front side panel 236*a* and front panel 230 and hingedly connected thereto along respective longitudinal fold lines 255*a*, 225*a*. Hood blank 214 also includes a second front corner panel 274*b* disposed between second front side panel 236*b* and front panel 230 and hingedly connected thereto along respective longitudinal fold lines 255*b*, 225*b*. Top panel 232 includes angled corner edges 275*a*, 275*b*, 281*a*, 281*b* that are sized and disposed so as to abut the adjacent edge of respective corner panels 274*a*, 274*b*, 270*a*, 270*b* when the shipper display 290 is constructed.

Hood blank 214 includes first and second notches 240*a*, 240*b* that are struck primarily from a bottom edge of respective first and second front side panels 236*a*, 236*b* and respective first and second front corner panels 274*a*, 274*b*. As shown, first and second notches 240*a*, 240*b* also extend slightly into front panel 230. Notches 240*a*, 240*b* are configured to overlie respective first and second front corner flaps 228*a*, 228*b* as well as respective first and second bottom front corner panels 272*a*, 272*b* when the shipper display 290 is in its shipping configuration.

In the illustrated third embodiment, back panel 218 of tray blank 212 includes two access apertures 277, and front panel 230 of hood blank 214 includes a single access aperture 279. As shown in FIG. 20, access apertures 277 are disposed so as to be partially overlapped by the outermost edge of top rear glue flap 234 when the shipper display 290 is in the shipping configuration. Access apertures 277 can be used, e.g., by insertion of a finger or tool therein, to facilitate the separation of top rear glue flap 234 from back panel 218 when transitioning the shipper display 290 from the shipping to the display configuration. As shown in FIG. 19, access aperture 279 is disposed so as to be partially overlapped by the outermost edge of bottom front panel 222 when the shipper display 290 is in the shipping configuration. Access aperture 279 can be used, e.g., by insertion of a finger or tool therein, to facilitate the separation of front panel 230 from bottom front panel 222 when transitioning the shipper display 290 from the shipping to the display configuration.

Also disclosed are methods of using standard equipment to create the blanks described above for forming the shelf-ready shipper display systems described above. The configuration of the shipper displays described above is such that the blanks used in their formation can be manufactured and formed by conventional machinery standard in the industry. Specifically, the shipper displays may be formed from two die-cut blanks that are pre-joined via two-piece joiner equipment or a Bobst poly joiner to form a composite blank. The composite blank may be formed into an assembled shipper display via a standard wrap-around case packing machine. The ability to manufacture and form the shipper display using standard equipment can result in both cost and time savings.

Moreover, the shipper displays of the present invention may require less material than conventional shipper displays and may therefore be less expensive to manufacture. The shipper displays may also be dimensioned to eliminate empty space on the retail shelf.

Changes and modifications, additions and deletions may be made to the structures and methods recited above and shown in the drawings without departing from the scope or spirit of the invention and the following claims.

What is claimed is:

1. A display system for containing and displaying product comprising:

a tray portion comprising a bottom panel;

a hood portion comprising a top panel and at least one glue flap panel disposed adjacent to said top panel;

wherein the display system is convertible from a shipping configuration to a display configuration;

wherein when the display system is in the shipping configuration, the tray portion and hood portion cooperate to form an enclosed carton;

wherein when the display system is in the display configuration, the hood portion is separated completely from the tray portion;

wherein the display system is configured to be transitioned from said shipping configuration to said display configuration by breaking an adhesive connection between said at least one glue flap panel and said tray portion and lifting said hood portion away from said tray portion, wherein said tray portion further comprises a back panel, a bottom front panel, and first and second bottom side panels, wherein said tray portion further comprises first and second rear side panels, wherein said first and second rear side panels extend vertically between said bottom panel and said top panel when said display system is in the shipping configuration, wherein said hood portion further comprises a front panel that is disposed opposite said back panel when the display system is in the shipping configuration, wherein said hood portion further comprises first and second side panels, wherein said first and second front side panels extend vertically between said bottom panel and said top panel when said display system is in the shipping configuration, wherein said first front side panel and said first rear side panel together form a first side wall of the display system in the shipping configuration, and wherein said second front side panel and said second rear side panel together form a second side wall of the display system in the shipping configuration, wherein said first and second front side panels define at least in part respective first and second notches, wherein said first and second notches are sized and configured so as to overlie said respective first and second front corner flaps when the display system is in said shipping configuration.

2. The display system of claim 1, wherein said display system in said shipping configuration includes a second adhesive connection between a bottom front panel of said tray portion and a front panel of said hood portion, and wherein said second adhesive connection is configured so as to be broken when said hood portion is lifted away from said tray portion to transition the display system to said display configuration.

3. The display system of claim 1, wherein said at least one glue flap comprises first and second top side glue flaps, wherein said first top side glue flap is secured to said first side wall when said display system is in the shipping configuration, wherein said second top side glue flap is secured to said second side wall when said display system is in the shipping configuration.

4. The display system of claim 1, wherein said at least one glue flap comprises a top rear glue flap, wherein said top rear glue flap is secured to said back panel when said display system is in the shipping configuration.

5. The display system of claim 1, wherein said first and second notches extend partially into said front panel.

6. A set of blanks for forming a display system, the set of blanks comprising:

a first blank configured to form a tray portion of a set-up display system, the first blank comprising a bottom panel; and a second blank configured to form a hood portion of the set-up display system, the second blank comprising a top panel and at least one glue flap panel hingedly connected to said top panel;

wherein the set-up display system is convertible from a shipping configuration to a display configuration;

wherein when the set-up display system is in the shipping configuration, the tray portion and hood portion cooperate to form an enclosed carton;

wherein when the set-up display system is in the display configuration, the hood portion is separated completely from the tray portion;

wherein the set-up display system is configured to be transitioned from said shipping configuration to said display configuration by breaking an adhesive connection between said at least one glue flap panel and said tray portion and lifting said hood portion away from said tray portion, wherein said first blank further comprises a back panel, a bottom front panel, and first and second bottom side panels, wherein said first blank further comprises first and second rear side panels, wherein said first and second rear side panels are configured to extend vertically between said bottom panel and said top panel when said set-up display system is in the shipping configuration, wherein said second blank further comprises a front panel that is disposed opposite said back panel when the set-up display system is in the shipping configuration, wherein said second blank further comprises first and second front side panels, wherein said first and second front side panels extend vertically between said bottom panel and said top panel when said set-up display system is in the shipping configuration, wherein said first front side panel and said first rear side panel together form a first side wall of the display system in the shipping configuration, and wherein said second front side panel and said second rear side panel together from a second side wall of the set-up display system in the shipping configuration, wherein said first and second front side panels define at least in part respective first and second notches, wherein said first and second notches are sized and configured so as to overlie said respective first and second front corner flaps when the set-up display system is in said shipping configuration.

7. The set of blanks of claim 6, wherein said set-up display system in said shipping configuration includes a second adhesive connection between a bottom front panel of said tray portion and a front panel of said hood portion, and wherein said second adhesive connection is configured so as to be broken when said hood portion is lifted away from said tray portion to transition the set-up display system to said display configuration.

8. The set of blanks of claim 6, wherein said at least one glue flap comprises first and second top side glue flaps, wherein said first top side glue flap is secured to said first side wall when said set-up display system is in the shipping configuration, wherein said second top side glue flap is secured to said second side wall when said set-up display system is in the shipping configuration.

9. The set of blanks of claim 6, wherein said at least one glue flap comprises a top rear glue flap, wherein said top rear glue flap is secured to said back panel when said set-up display system is in the shipping configuration.

10. The set of blanks of claim 6, wherein said first and second notches extend partially into said front panel.

11. A composite blank formed from the set of blanks of claim 6, wherein said composite blank is formed by joining a bottom front panel of said tray blank to a lowermost portion of a front panel of said hood blank.

* * * * *